US012305652B2

(12) United States Patent
Yamaguchi

(10) Patent No.: US 12,305,652 B2
(45) Date of Patent: May 20, 2025

(54) VACUUM PUMP

(71) Applicant: Edwards Japan Limited, Chiba (JP)

(72) Inventor: Toshiki Yamaguchi, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 18/547,938

(22) PCT Filed: Mar. 11, 2022

(86) PCT No.: PCT/JP2022/010898
§ 371 (c)(1),
(2) Date: Aug. 25, 2023

(87) PCT Pub. No.: WO2022/196560
PCT Pub. Date: Sep. 22, 2022

(65) Prior Publication Data

US 2024/0141906 A1 May 2, 2024

(30) Foreign Application Priority Data

Mar. 17, 2021 (JP) ..... 2021-044046

(51) Int. Cl.
*F04D 17/16* (2006.01)
*F04D 29/28* (2006.01)
*F04D 29/42* (2006.01)

(52) U.S. Cl.
CPC ..... *F04D 17/168* (2013.01); *F04D 29/28* (2013.01); *F04D 29/4206* (2013.01)

(58) Field of Classification Search
CPC ..... F04D 17/168; F04D 19/04–048; F04D 29/28; F04D 29/4206; F04D 29/058
See application file for complete search history.

(56) References Cited

U.S. PATENT DOCUMENTS 4,826,393 A * 5/1989 Miki ..... F04D 19/046 415/72
5,190,438 A 3/1993 Taniyama et al.
(Continued)

FOREIGN PATENT DOCUMENTS

DE 102006043327 A1 * 3/2008 ..... F04D 17/02
JP H0674187 A 3/1994
(Continued)

OTHER PUBLICATIONS

PCT International Search Report dated Jun. 7, 2022 for corresponding PCT application Serial No. PCT/JP2022/010898, 2 pages.
(Continued)

*Primary Examiner* — Brian P Wolcott

(74) *Attorney, Agent, or Firm* — Theodore M. Magee; Westman, Champlin & Koehler, P.A.

(57) ABSTRACT

A vacuum pump is provided with which, even in the event of breakage of a rotor blade, broken pieces of the rotor blade are unlikely to scatter from an outlet port. A vacuum pump includes a rotor blade configured to rotate about a vertical axis and a casing housing the rotor blade, and is configured to exhaust sucked gas in a radial direction of the rotor blade by rotation of the rotor blade. An outlet port for the gas is provided at a position that is offset from a position of a gas exit portion of the rotor blade in a direction of the vertical axis.

9 Claims, 9 Drawing Sheets

(56) References Cited

U.S. PATENT DOCUMENTS

| | | | | | |
|---|---|---|---|---|---|
| 5,562,405 | A * | 10/1996 | Ryall | F04D 31/00 | 415/72 |
| 5,695,316 | A * | 12/1997 | Schutz | F04D 23/008 | 417/423.4 |
| 6,302,641 | B1 * | 10/2001 | Iwane | F04D 19/044 | 415/72 |
| 6,422,829 | B1 * | 7/2002 | Schutz | F04D 17/168 | 417/205 |
| 6,514,035 | B2 * | 2/2003 | Iwane | F04D 29/547 | 415/72 |
| 6,579,060 | B1 | 6/2003 | Mann, III et al. | | |
| 8,297,949 | B1 | 10/2012 | Manci et al. | | |
| 9,771,940 | B2 * | 9/2017 | Tsubokawa | F04D 19/046 | |
| 10,364,814 | B2 | 7/2019 | Shi et al. | | |
| 2002/0122729 | A1 | 9/2002 | Yamashita et al. | | |
| 2010/0196174 | A1 | 8/2010 | Lee | | |
| 2018/0266426 | A1 | 9/2018 | Lee et al. | | |

FOREIGN PATENT DOCUMENTS

| | | | |
|---|---|---|---|
| JP | H08511071 | A | 11/1996 |
| JP | 2005042709 | A | 2/2005 |
| JP | 2005194994 | A * | 7/2005 |
| JP | 2005307859 | A | 11/2005 |
| JP | 2008045557 | A | 2/2008 |
| JP | 2019203511 | A | 11/2019 |

OTHER PUBLICATIONS

PCT International Written Opinion dated Jun. 7, 2022 for corresponding PCT application Serial No. PCT/JP2022/010898, 5 pages.
Japanese Office Action dated Nov. 12, 24 for corresponding Japanese application Serial No. 2021-044046, 6 pages.
European Communication dated Dec. 20, 2024 and Search Report dated Dec. 9, 2024 for corresponding European application Serial No. EP22771308, 8 pages.

* cited by examiner

VACUUM PUMP

CROSS-REFERENCE OF RELATED APPLICATION

This application is a Section 371 National Stage Application of International Application No. PCT/JP2022/010898, filed Mar. 11, 2022, which is incorporated by reference in its entirety and published as WO 2022/196560A1 on Sep. 22, 2022 and which claims priority of Japanese Application No. 2021-044046, filed Mar. 17, 2021.

FIELD

The present invention relates to a vacuum pump.

BACKGROUND

As background art in this technical field, a vacuum pump is of a vertical type and configured by housing multiple stages of rotor blades inside a substantially cylindrical upper housing. The upper housing includes an inlet port formed in its top portion and an outlet port formed in the side surface of its bottom portion. The rotor blades in multiple stages rotate to suck gas vertically downward from the inlet port and exhaust the gas in a horizontal direction from the outlet port.

The discussion above is merely provided for general background information and is not intended to be used as an aid in determining the scope of the claimed subject matter. The claimed subject matter is not limited to implementations that solve any or all disadvantages noted in the background.

SUMMARY

In prior vacuum pumps, the outlet port is provided at the same height position as the gas exit portion of the rotor blade in the last stage. As such, in the event of breakage of the rotor blade, broken pieces may scatter from the outlet port. If broken pieces of the rotor blade scatter from the outlet port, the piping or devices provided downstream of the pump may be damaged. This is undesirable. Also, the gas is exhausted from the outlet port in a horizontal direction. This may cause pressure loss, which will be described below, depending on the direction of the velocity vector of the gas and the opening condition and position of the outlet port, and thus lower the exhaust performance.

It is an object of the present invention to provide a vacuum pump with which, even in the event of breakage of a rotor blade, broken pieces of the rotor blade are unlikely to scatter from an outlet port. Another object of the present invention is to provide a vacuum pump capable of improving exhaust performance.

To achieve the above object, the present invention is directed to a vacuum pump including: a rotor blade configured to rotate about a vertical axis; and a casing housing the rotor blade, wherein the vacuum pump is configured to exhaust sucked gas in a radial direction of the rotor blade by rotation of the rotor blade, and an outlet port for the gas is provided at a position that is offset from a position of a gas exit portion of the rotor blade in a direction of the vertical axis.

In the above configuration, the outlet port is preferably provided in a side portion of the casing.

In the above configuration, the outlet port is preferably placed at such a position that the gas exit portion of the rotor blade is not visually perceivable when an interior of the casing is viewed through the outlet port.

In the above configuration, an inlet port is preferably provided in an upper portion of the casing, and the outlet port is preferably provided on an opposite side of the rotor blade from the inlet port in the direction of the vertical axis.

In the above configuration, an upper end position in the direction of the vertical axis of the outlet port is preferably at a predetermined distance from a lower end position in the direction of the vertical axis of the gas exit portion of the rotor blade.

The above configuration preferably includes an annular flow passage that is formed around the rotor blade and provides communication between the gas exit portion of the rotor blade and the outlet port, and the gas exhausted from the gas exit portion of the rotor blade in the radial direction of the rotor blade is preferably exhausted from the outlet port after swirling in the flow passage.

In the above configuration, the outlet port is preferably provided to protrude in a tangential direction of an outer circumference surface of the casing.

In the above configuration, the rotor blade is preferably one of a plurality of rotor blades provided in multiple stages in the direction of the vertical axis, and the plurality of rotor blades is preferably all constituted of centrifugal rotor blades that exhaust the gas in the radial direction of the rotor blades, or constituted of a combination of the centrifugal rotor blade and an axial-flow rotor blade that exhausts gas in the direction of the vertical axis.

The above configuration preferably includes a magnetic bearing configured to magnetically levitate a rotating shaft of the rotor blade.

According to the present invention, a vacuum pump can be provided with which, even in the event of breakage of a rotor blade, broken pieces of the rotor blade are unlikely to scatter from an outlet port. Additionally, according to the present invention, the exhaust performance of the vacuum pump can be improved. Problems to be solved, configurations, and advantageous effects other than those described above will be recognized by the following description of embodiments.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
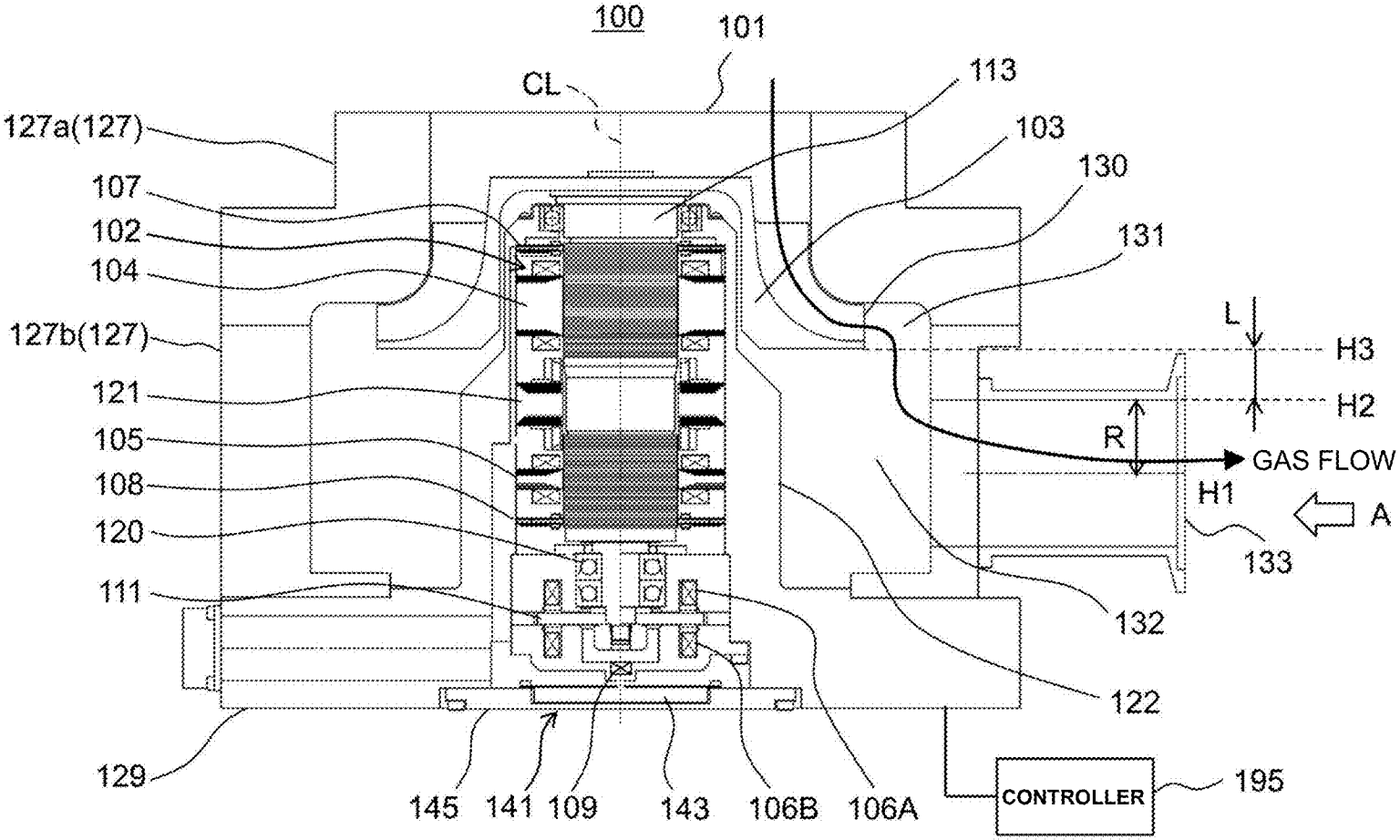
FIG. 1 is a longitudinal cross-sectional view of a vacuum pump according to a first embodiment of the present invention.

Referring to the drawings, embodiments of a vacuum pump according to the present invention are now described.

First Embodiment

FIG. 1 is a longitudinal cross-sectional view of a vacuum pump 100. As shown in FIG. 1, the vacuum pump 100 according to the present embodiment is a single-stage centrifugal pump. In FIG. 1, the vacuum pump 100 has an inlet port 101 formed at the upper end of a circular outer cylinder 127 (127*a*, 127*b*), which can be divided into two upper and lower stages. An impeller (rotor blade) 103 for drawing and exhausting gas is provided in a single stage inside the outer cylinder (casing) 127. A rotor shaft (rotating shaft) 113 is attached to the center of the impeller 103. This rotor shaft 113 is levitated, supported, and position-controlled by a magnetic bearing 102 of 5-axis control, for example. The impeller 103 is typically made of a metal such as aluminum or an aluminum alloy. Of course, the metal used for the impeller 103 is not limited to these. For example, the impeller 103 may be made of a metal such as stainless steel, a titanium alloy, or a nickel alloy.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Each upper radial sensor 107 may be an inductance sensor or an eddy current sensor having a conduction winding, for example, and detects a position of the rotor shaft 113 based on a change in the inductance of the conduction winding, which changes according to the position of the rotor shaft 113. The upper radial sensors 107 are configured to detect a radial displacement of the rotor shaft 113, that is, the impeller 103 fixed to the rotor shaft 113, and send it to the controller 195.

In the controller 195, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) shown in FIG. 2 controls and excites the upper radial electromagnets 104 to adjust a radial position of an upper part of the rotor shaft 113.

The rotor shaft 113 may be made of a high magnetic permeability material (such as iron and stainless steel) and is configured to be attracted by magnetic forces of the upper radial electromagnets 104. The adjustment is performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has a shape of a circular disc and is provided in the lower part of the rotor shaft 113. The metal disc 111 is made of a high magnetic permeability material such as iron. An axial sensor 109 is provided to detect an axial displacement of the rotor shaft 113 and send an axial position signal to the controller 195.

In the controller 195, the compensation circuit having the PID adjustment function may generate an excitation control command signal for each of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 is thus adjusted.

As described above, the controller 195 appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. Each magnetic pole is controlled by the controller 195 so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 is detected based on a detection signal of the rotational speed sensor.

Furthermore, a phase sensor (not shown) is attached adjacent to the lower radial sensors 108 to detect the phase of rotation of the rotor shaft 113. The controller 195 detects the position of the magnetic poles using both detection signals of the phase sensor and the rotational speed sensor.

The impeller 103 rotates in a predetermined direction about a central axis (vertical axis) CL. The gas drawn from the inlet port 101 is discharged through a gas exit portion 130 in a radial direction (right-left direction in FIG. 1). As will be described in detail below, the gas discharged from the gas exit portion 130 swirls in an annular buffer space 131 (see FIG. 5), then passes through an interior space 132, and is discharged from the outlet port 133 as indicated by an arrow in FIG. 1. The interior space 132 is an annular space formed between the outer cylinder 127 and the stator column 122 and continuous with the buffer space 131.

A base portion 129 is located at the base of the outer cylinder 127. The outlet port 133 is provided between the upper outer cylinder 127*a* and the base portion 129, that is, in the side portion of the lower outer cylinder 127*b*, and communicates with the outside. The gas drawn downward along the central axis CL from the inlet port 101 changes direction in a radial direction of the impeller 103 due to the rotation of the impeller 103 and is sent out to the outlet port 133.

The outlet port 133 is placed at a height position offset downward from the position of the gas exit portion 130 in a direction of the central axis CL (up-down direction in FIG. 1). Specifically, an upper end position H2 of the outlet port 133 located upward from a center position H1 of the outlet port 133 by the radius R is offset downward by a distance L from a lower end position H3 of the gas exit portion 130. In other words, the outlet port 133 is placed radially outward and axially downward of the impeller 103 with a predetermined distance therebetween. When the user looks into the outlet port 133 from direction A in FIG. 1, the user can visually perceive the interior space 132 but cannot visually perceive the gas exit portion 130 because the gas exit portion 130 is located above the outlet port 133. Also, the outlet port 133 is located on the opposite side of the impeller 103 from the inlet port 101 in the direction of central axis CL.

The base portion 129 is a disc-shaped member forming the base section of the vacuum pump 100, and is generally made of a metal such as iron, aluminum, or stainless steel. The base portion 129 physically holds the vacuum pump 100 and also serves as a heat conduction passage. As such, the base portion 129 is preferably made of rigid metal with high thermal conductivity, such as iron, aluminum, or copper.

In this configuration, when the motor 121 drives and rotates the impeller 103 together with the rotor shaft 113, the action of the impeller 103 draws gas through the inlet port 101.

According to the application of the vacuum pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 may be maintained at a predetermined pressure by purge gas.

In this case, the base portion 129 has a pipe (not shown) through which the purge gas is introduced. The introduced purge gas is sent to the outlet port 133 through gaps between a protective bearing 120 and the rotor shaft 113, between the rotor and the stator of the motor 121, and between the stator column 122 and the inner circumference cylindrical portion of the impeller 103. A heater or a water-cooled tube, for example, may be provided at the outer circumference of the base portion 129 depending on the temperature or type of the gas to be drawn. In this case, it is preferable to provide a temperature sensor in the base portion 129 and perform temperature control by the controller 195.

The vacuum pump 100 requires the identification of the model and control based on individually adjusted unique parameters (for example, various characteristics associated with the model). To store these control parameters, the vacuum pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 is housed under a rotational speed sensor (not shown) near the center, for example, of the base portion 129, which forms the lower part of the vacuum pump 100, and is closed by an airtight bottom lid 145.

Figure 2:
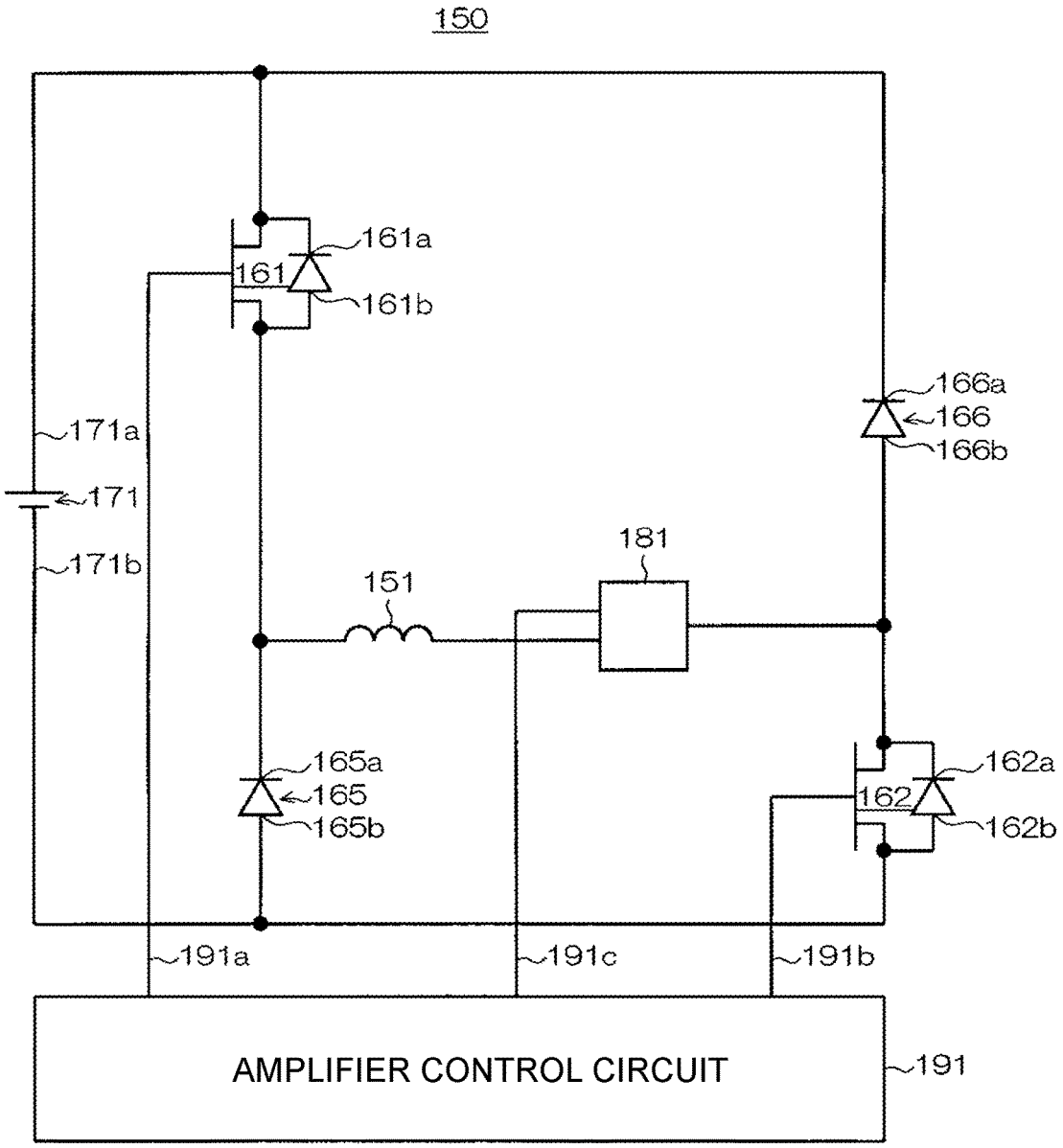
FIG. 2 is a circuit diagram of an amplifier circuit of the vacuum pump shown in FIG. 1.

The amplifier circuit 150 is now described that controls and excites the upper radial electromagnets 104, the lower radial electromagnets 105, and the axial electromagnets 106A and 106B of the vacuum pump 100 configured as described above. FIG. 2 is a circuit diagram of the amplifier circuit 150.

In FIG. 2, one end of an electromagnet winding 151 forming an upper radial electromagnet 104 or the like is connected to a positive electrode 171*a* of a power supply 171 via a transistor 161, and the other end is connected to a negative electrode 171*b* of the power supply 171 via a current detection circuit 181 and a transistor 162. Each transistor 161, 162 is a power MOSFET and has a structure in which a diode is connected between the source and the drain thereof.

In the transistor 161, a cathode terminal 161*a* of its diode is connected to the positive electrode 171*a*, and an anode terminal 161*b* is connected to one end of the electromagnet winding 151. In the transistor 162, a cathode terminal 162*a* of its diode is connected to a current detection circuit 181, and an anode terminal 162*b* is connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing 102 uses 5-axis control and has ten electromagnets 104, 105, 106A, and 106B in total, an identical amplifier circuit 150 is configured for each of the electromagnets. These ten amplifier circuits 150 are connected to the power supply 171 in parallel.

An amplifier control circuit 191 may be formed by a digital signal processor portion (not shown, hereinafter referred to as a DSP portion) of the controller 195. The amplifier control circuit 191 switches the transistors 161 and 162 between on and off.

The amplifier control circuit 191 is configured to compare a current value detected by the current detection circuit 181 (a signal reflecting this current value is referred to as a current detection signal 191*c*) with a predetermined current command value. The result of this comparison is used to determine the magnitude of the pulse width (pulse width time Tp1, Tp2) generated in a control cycle Ts, which is one cycle in PWM control. As a result, gate drive signals 191*a* and 191*b* having this pulse width are output from the amplifier control circuit 191 to gate terminals of the transistors 161 and 162.

Under certain circumstances such as when the rotational speed of the impeller 103 reaches a resonance point during acceleration, or when a disturbance occurs during a constant speed operation, the impeller 103 may require positional control at high speed and with a strong force. For this purpose, a high voltage of about 50 V, for example, is used for the power supply 171 to enable a rapid increase (or decrease) in the current flowing through the electromagnet winding 151. Additionally, a capacitor is generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current is maintained. Passing the freewheeling current through the amplifier circuit 150 in this manner reduces the hysteresis loss in the amplifier circuit 150, thereby limiting the power consumption of the entire circuit to a low level. Moreover, by controlling the transistors 161 and 162 as described above, high frequency noise, such as harmonics, generated in the vacuum pump 100 can be reduced. Furthermore, by measuring this freewheeling current with the current detection circuit 181, the electromagnet current iL flowing through the electromagnet winding 151 can be detected.

Figure 3:
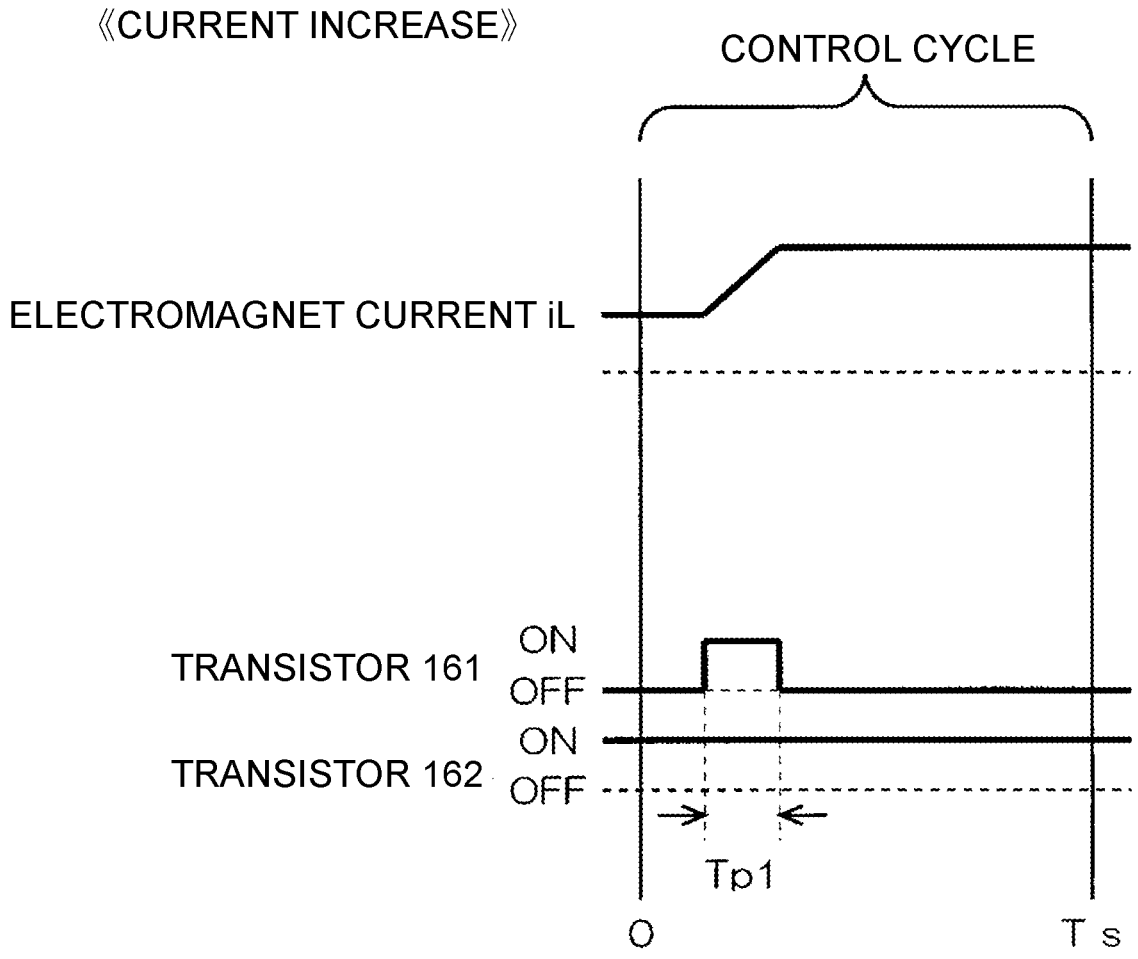
FIG. 3 is a time chart showing control of an amplifier control circuit performed when a current command value is greater than a detected value.

That is, when the detected current value is smaller than the current command value, as shown in FIG. 3, the transistors 161 and 162 are simultaneously on only once in the control cycle Ts (for example, 100 μs) for the time corresponding to pulse width time Tp1. During this time, the electromagnet current iL increases accordingly toward the current value iLmax (not shown) that can be passed from the positive electrode 171*a* to the negative electrode 171*b* via the transistors 161 and 162.

Figure 4:
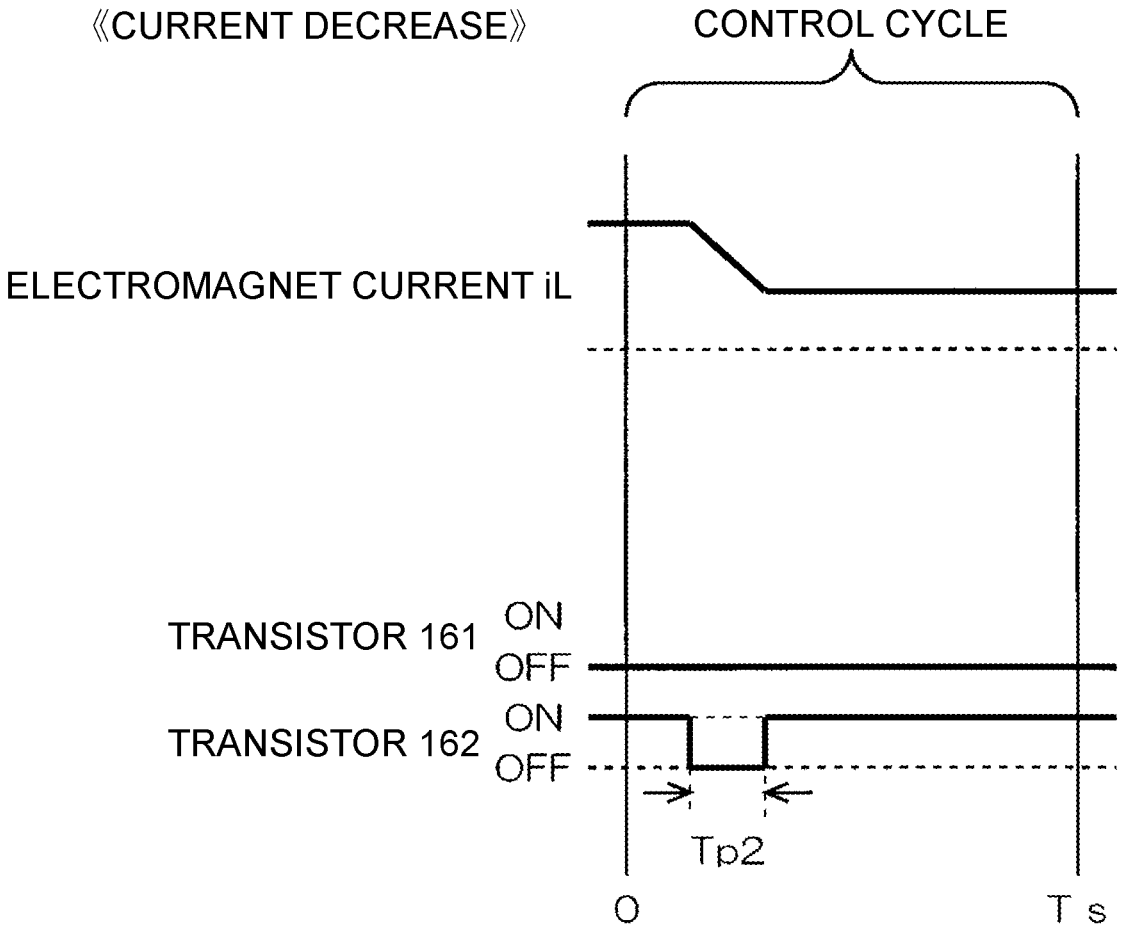
FIG. 4 is a time chart showing control of an amplifier control circuit performed when a current command value is less than a detected value.

When the detected current value is larger than the current command value, as shown in FIG. 4, the transistors 161 and 162 are simultaneously off only once in the control cycle Ts for the time corresponding to pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after pulse width time Tp1, Tp2 has elapsed, one of the transistors 161 and 162 is on. During this period, the freewheeling current is thus maintained in the amplifier circuit 150.

Figure 5:
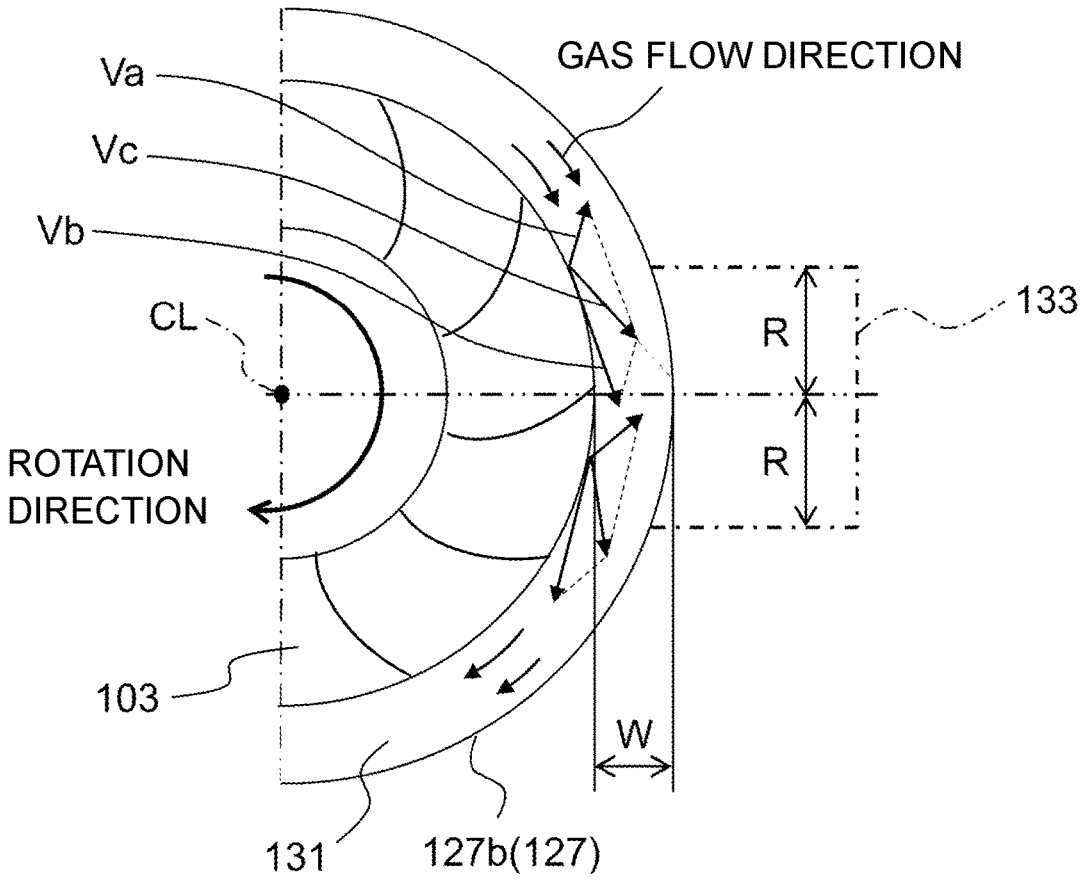
FIG. 5 is an explanatory diagram showing the flow of gas around an outlet port.

The flow of gas around the outlet port 133 is now described. FIG. 5 is an explanatory diagram showing the flow of gas around the outlet port 133. FIG. 5 schematically shows the vacuum pump 100 that is cut along a plane perpendicular to the central axis CL at the height position (near H3) of the gas exit portion 130.

As shown in FIG. 5, when the impeller 103 rotates clockwise about the central axis CL, the gas is discharged in the direction of a velocity vector Vc, which is the resultant of a velocity vector Va at the gas exit portion 130 and a velocity vector Vb created by being dragged by the impeller 103. Then, the gas is discharged from the outlet port 133 after swirling in the buffer space (flow passage) 131, which is formed in an annular shape.

Here, a width W of the buffer space 131 is slightly less than the radius R of the outlet port 133. However, since the outlet port 133 is offset in the direction of the central axis CL, the buffer space 131 is a sufficient space not only in the radial direction but also in the axial direction. As such, the gas discharged from the gas exit portion 130 in the radial direction of the impeller 103 is smoothly guided to the outlet port 133 through the buffer space 131 and discharged to the outside from the outlet port 133.

The first embodiment configured as described above has the following advantageous effects.

The height position of the outlet port 133 is offset downward from the gas exit portion 130. Thus, even in the event of breakage of the impeller 103, broken pieces of the impeller 103 are unlikely to scatter from the outlet port 133. If the impeller 103 breaks, broken pieces of the impeller 103 fly out from the gas exit portion 130 in the radial direction of the impeller 103, but collide with the inner circumference wall of the buffer space 131. Thus, the possibility of the broken pieces directly scattering to the outside from the outlet port 133 is low. As a result, in the system in which the vacuum pump 100 is installed, major troubles can be avoided, thereby achieving a highly reliable vacuum pump 100.

Also, since a sufficient buffer space 131 is provided between the gas exit portion 130 and the outlet port 133, the buffer space 131 reduces pressure loss. More specifically, the circumferential velocity component of the gas discharged from the impeller 103 decreases as the gas circulates (swirls) in the buffer space 131. This reduces the gas circulating and remaining in the vacuum pump 100, thereby reducing the pressure loss. As a result, the gas is smoothly discharged from the outlet port 133, and the exhaust performance of the vacuum pump 100 is improved.

Also, since the outlet port 133 is provided in the side portion of the outer cylinder 127, it is easy to connect piping to the outlet port 133. Additionally, providing the outlet port 133 at a position facing the interior space 132 allows the radial position of the outlet port 133 to be on the inner circumference side (radially inward) as compared to a configuration in which the buffer space extends only in the radial direction. This allows the outlet port 133 to be compact in the radial direction. Furthermore, since the impeller 103 is magnetically levitated by the magnetic bearing 102, the impeller 103 can, obviously, rotate at a high speed.

First Modification

Figure 6:
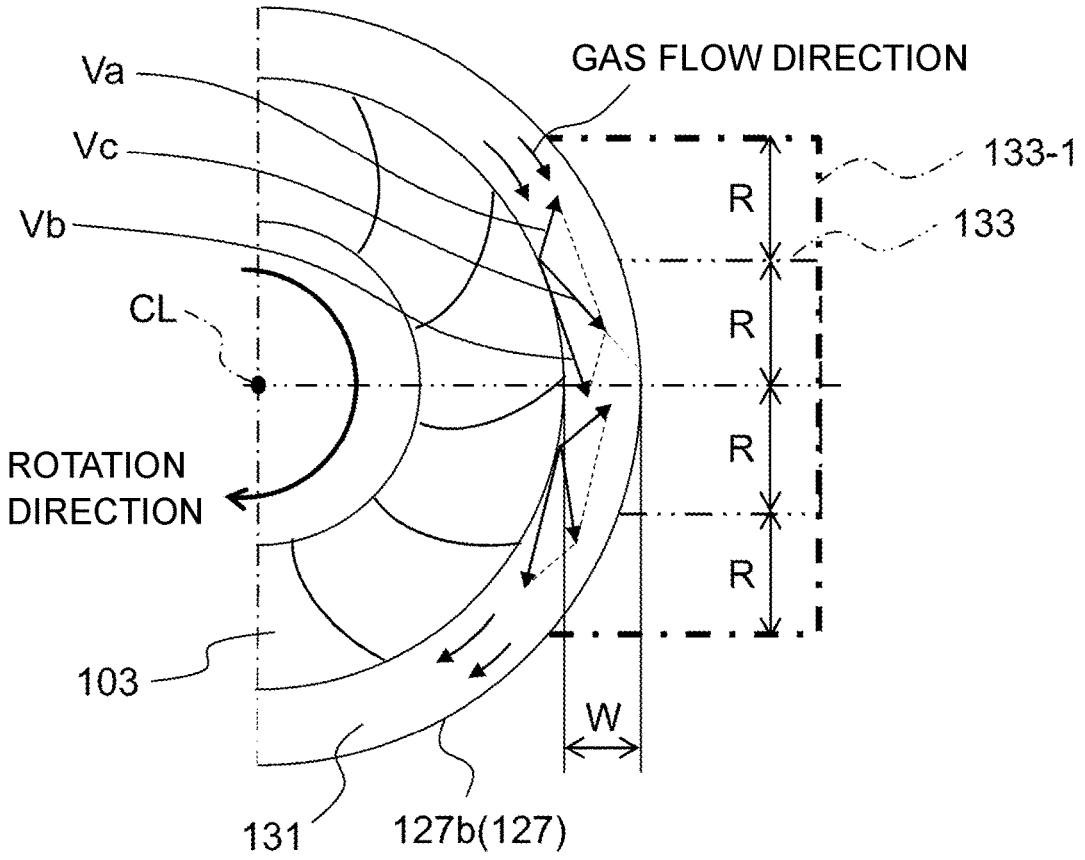
FIG. 6 is a diagram showing a configuration according to a first modification of an outlet port.

FIG. 6 is a diagram showing a configuration according to a first modification of an outlet port. As shown in FIG. 6, an outlet port 133-1 according to the first modification has a wider shape than the outlet port 133 shown in FIG. 5 (indicated by the dashed double-dotted lines in FIG. 6). Specifically, the opening of the outlet port 133-1 is approximately twice as large as the outlet port 133.

This configuration further reduces the gas pressure loss and thus further improves the exhaust performance of the vacuum pump 100.

Second Modification

Figure 7:
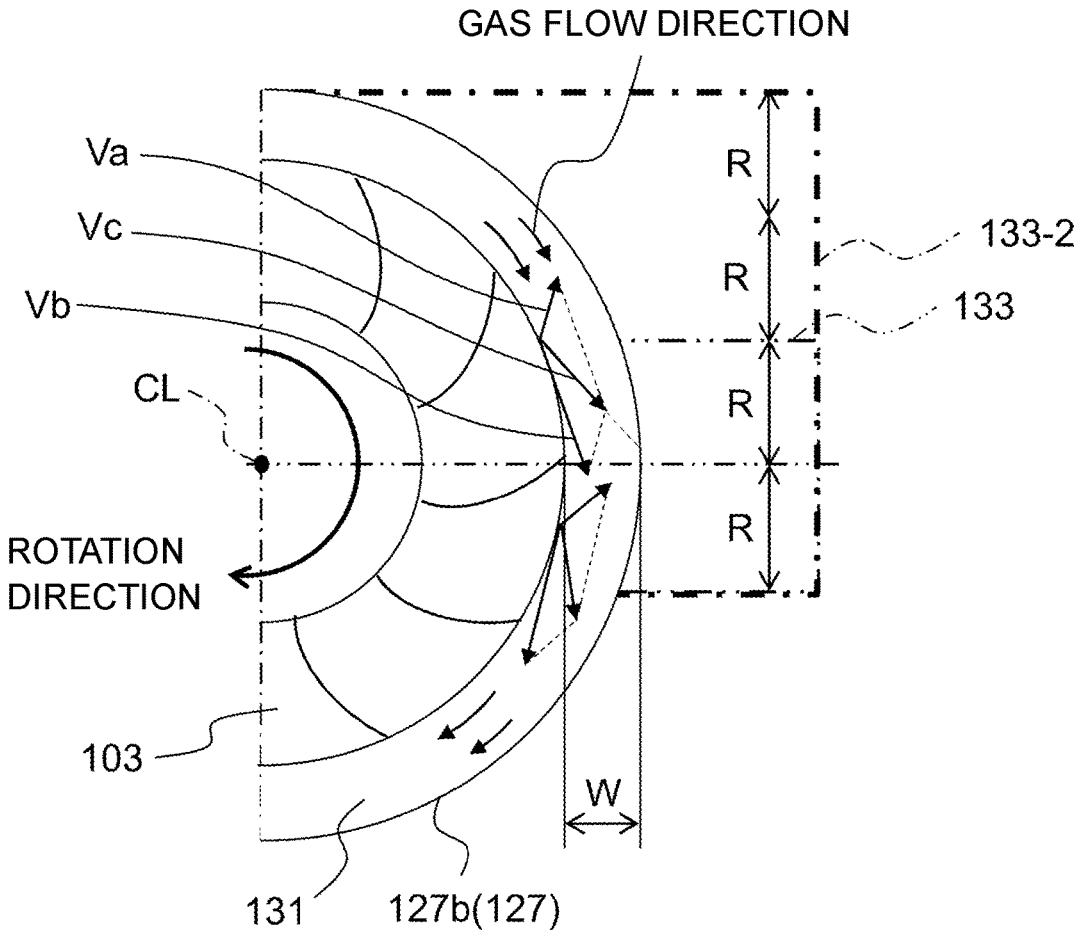
FIG. 7 is a diagram showing a configuration according to a second modification of an outlet port.

FIG. 7 is a diagram showing a configuration according to a second modification of an outlet port. The outlet port 133 shown in FIG. 5 (indicated by the dashed double-dotted lines in FIG. 7) and the outlet port 133-1 shown in FIG. 6 are provided to protrude in a direction perpendicular to the central axis CL. An outlet port 133-2 according to the second modification differs in that it protrudes in a tangential direction of the outer cylinder 127.

According to this configuration, since the outlet port 133-2 is provided in the gas exhaust direction, the gas can smoothly move toward the outlet port 133-2 after swirling in the buffer space 131. This further reduces the gas pressure loss and thus further improves the exhaust performance.

Second Embodiment

Figure 8:
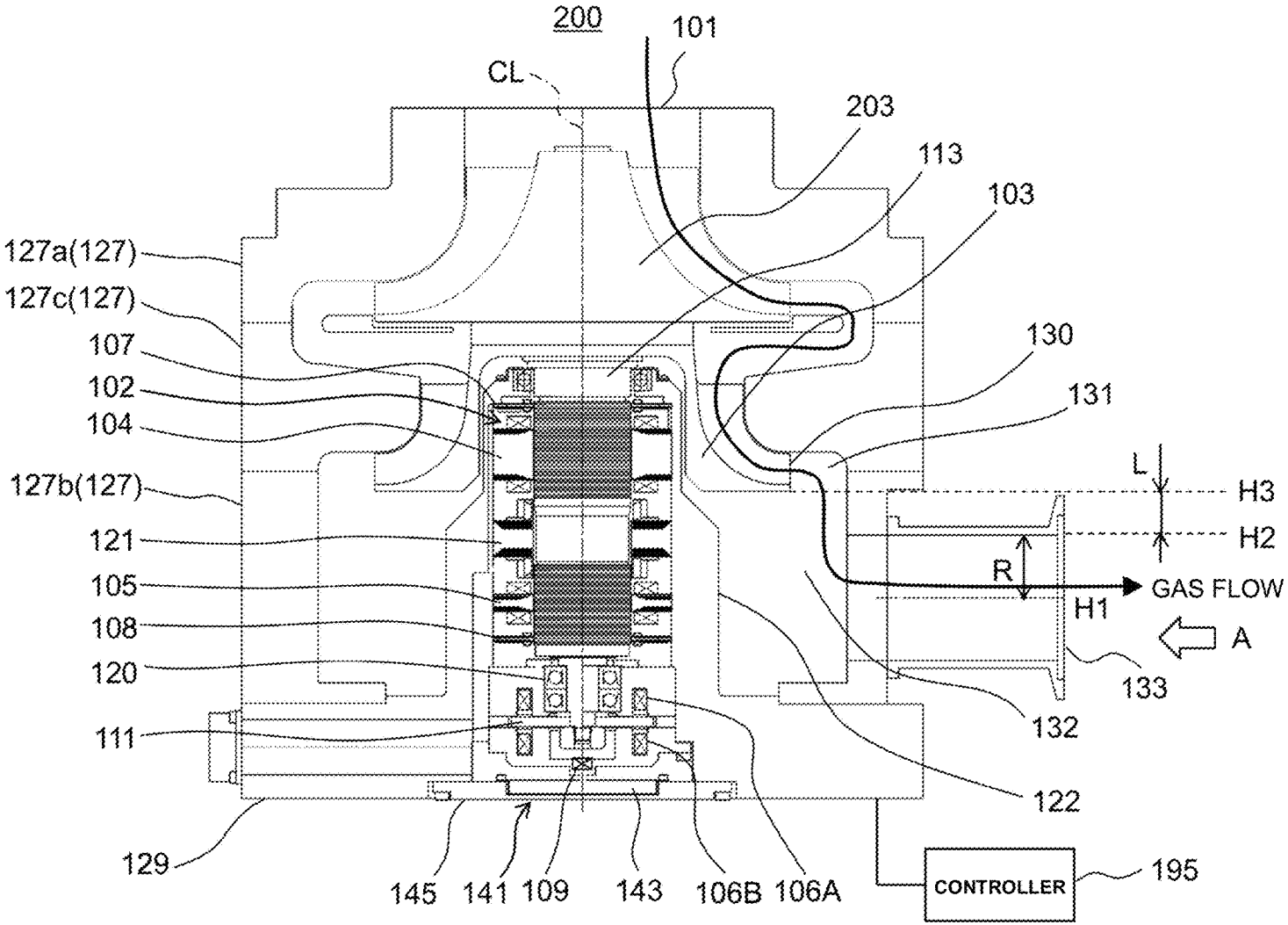
FIG. 8 is a longitudinal cross-sectional view of a vacuum pump according to a second embodiment of the present invention.

A vacuum pump 200 according to a second embodiment is now described. The same reference numerals are given to those configurations that are the same as the corresponding configurations of the first embodiment. Such configurations will not be described. FIG. 8 is a longitudinal cross-sectional view of the vacuum pump 200 according to the second embodiment of the present invention.

As shown in FIG. 8, the vacuum pump 200 according to the second embodiment includes impellers in multiple stages. That is, the vacuum pump shown in FIG. 8 is a multi-stage centrifugal pump. Specifically, an impeller 103 and an impeller 203 are arranged along the central axis CL. The impellers 103 and 203 may be the same or different from each other in structure (specification). In the second embodiment, an outer cylinder 127*c* is provided between an outer cylinder 127*a* and an outer cylinder 127*b* to house the impellers 103 and 203.

In the second embodiment, as indicated by an arrow in the figure, the gas drawn downward along the central axis CL from the inlet port 101 is turned by the impeller 203 in a radial direction and then guided to the impeller 103. Then, as in the first embodiment, the gas is discharged from the gas exit portion 130 of the impeller 103, swirls in the buffer space 131, and is then discharged from the outlet port 133.

As described above, the second embodiment has the same advantageous effects as the first embodiment. Also, since the impellers are provided in multiple stages, it is suitable when a large-capacity vacuum pump is needed.

Third Embodiment

Figure 9:
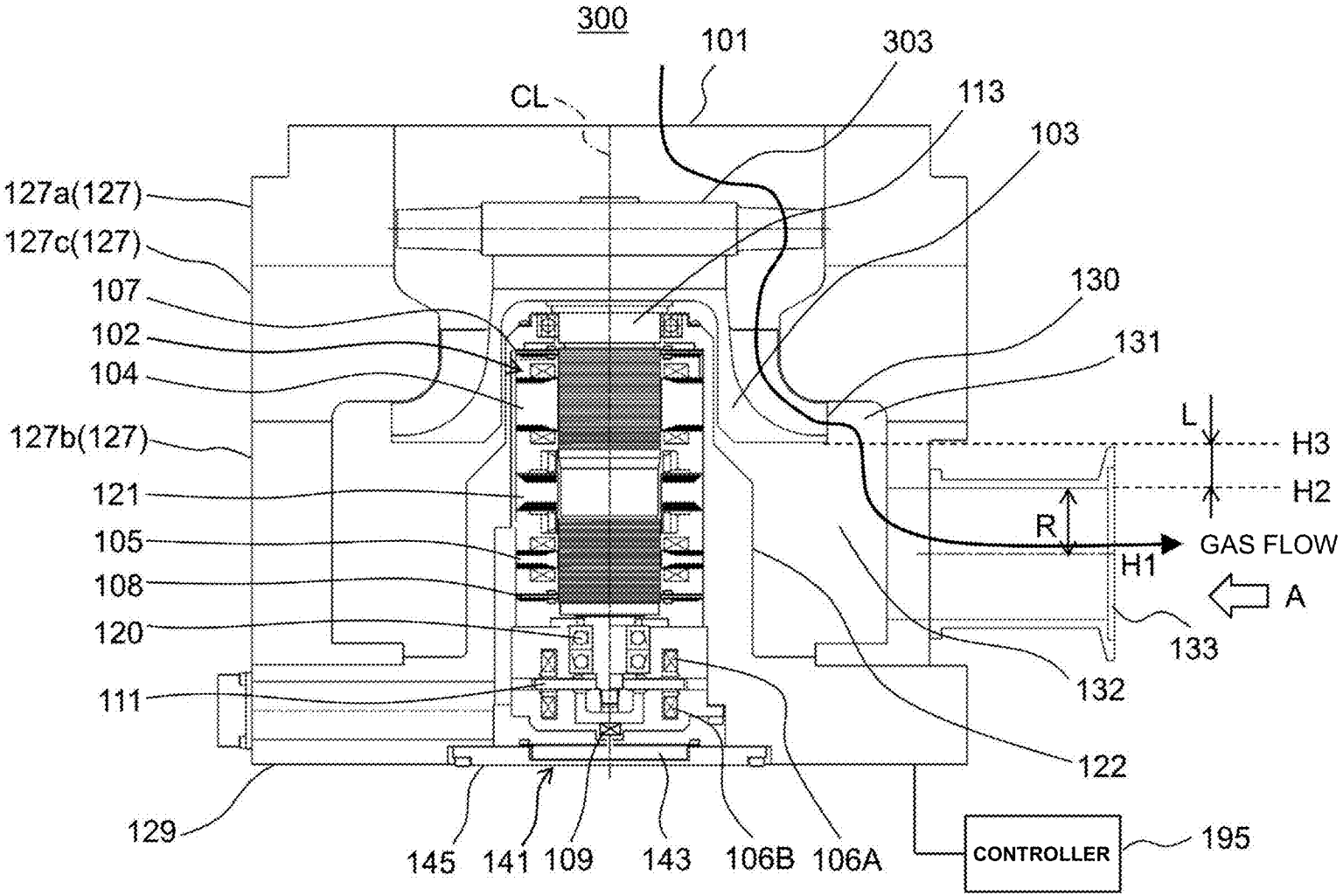
FIG. 9 is a longitudinal cross-sectional view of a vacuum pump according to a third embodiment of the present invention.

A vacuum pump 300 according to a third embodiment is now described. The same reference numerals are given to those configurations that are the same as the corresponding configurations of the first embodiment. Such configurations will not be described. FIG. 9 is a longitudinal cross-sectional view of the vacuum pump 300 according to the third embodiment of the present invention.

As shown in FIG. 9, the vacuum pump 300 according to the third embodiment is a multi-stage vacuum pump formed by a combination of an axial-flow rotor blade 303 and a centrifugal impeller 103. Specifically, the rotor blade 303 and the impeller 103 are arranged along the central axis CL in this order from the upstream side of the gas flow. In the third embodiment, an outer cylinder 127*c* is provided between an outer cylinder 127*a* and an outer cylinder 127*b* to house the rotor blade 303 and the impeller 103.

In the third embodiment, as indicated by an arrow in the figure, the gas drawn downward along the central axis CL from the inlet port 101 is transferred by the rotor blade 303 in the same direction and guided to the impeller 103. Then, as in the first embodiment, the gas is discharged from the gas exit portion 130 of the impeller 103, swirls in the buffer space 131, and is then discharged from the outlet port 133.

As described above, the third embodiment has the same advantageous effects as the first embodiment. Also, since the axial-flow rotor blade and the centrifugal impeller are provided in multiple stages, it is suitable when a large-capacity vacuum pump is needed.

The present invention is not limited to the embodiments described above, and various modifications can be made without departing from the scope of the present invention. The present invention encompasses all technical matters included in the technical idea described in the claims. Although the foregoing embodiments illustrate preferred examples, other alternations, variations, modifications, and combinations, or improvements will be apparent to those skilled in the art from the content disclosed herein, and may be made without departing from the technical scope defined by the appended claims.

For example, when there is space in the upper portion of the outer cylinder 127, the outlet port 133 may be provided at a position offset upward from the gas exit portion 130 along the central axis CL. In this case, broken pieces still do not scatter directly to the outlet port 133 from the gas exit portion 130, so that a highly reliable vacuum pump can be provided as in the above embodiments.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum pump comprising:

a rotor blade configured to rotate about a vertical axis and having a gas exit portion extending in a vertical direction to define a vertical extent;

a casing housing the rotor blade; and an unobstructed annular buffer space extending in a radial direction between the entire vertical extent of the gas exit portion to an annular surface, wherein the vacuum pump is configured to exhaust sucked gas in the radial direction of the rotor blade by rotation of the rotor blade, and an outlet port for the gas is provided at a position that is offset from a position of the gas exit portion of the rotor blade in a direction of the vertical axis.

2. The vacuum pump according to claim 1, wherein the outlet port is provided in a side portion of the casing.

3. The vacuum pump according to claim 2, wherein the outlet port is placed at such a position that the gas exit portion of the rotor blade is not visually perceivable when an interior of the casing is viewed through the outlet port.

4. The vacuum pump according to claim 2, wherein an inlet port is provided in an upper portion of the casing, and the outlet port is provided on an opposite side of the rotor blade from the inlet port in the direction of the vertical axis.

5. The vacuum pump according to claim 4, wherein an upper end position in the direction of the vertical axis of the outlet port is at a predetermined distance from a lower end position in the direction of the vertical axis of the gas exit portion of the rotor blade.

6. The vacuum pump according to claim 2, wherein the gas exhausted from the gas exit portion of the rotor blade in the radial direction of the rotor blade is exhausted from the outlet port after swirling in the buffer space.

7. The vacuum pump according to claim 6, wherein the outlet port is provided to protrude in a tangential direction of an outer circumference surface of the casing.

8. The vacuum pump according to claim 1, wherein the rotor blade is one of a plurality of rotor blades provided in multiple stages in the direction of the vertical axis, and the plurality of rotor blades is all constituted of centrifugal rotor blades that exhaust the gas in the radial direction of the rotor blades, or constituted of a combination of the centrifugal rotor blade and an axial-flow rotor blade that exhausts gas in the direction of the vertical axis.

9. The vacuum pump according to claim 1, further comprising a magnetic bearing configured to magnetically levitate a rotating shaft of the rotor blade.

* * * * *